US005799873A

United States Patent [19]

Lau

[11] Patent Number: 5,799,873

[45] Date of Patent: Sep. 1, 1998

[54] PORTABLE MULTI-PORT LIQUID DISPENSING SYSTEM

[76] Inventor: Billy Ying Bui Lau, 486 N. Vista Del Norte, Walnut, Calif. 91789

[21] Appl. No.: 857,034

[22] Filed: May 15, 1997

Related U.S. Application Data

[63] Continuation of Ser. No. 468,194, Jun. 6, 1995, abandoned.

[51] Int. Cl.[6] ..... B05B 9/043

[52] U.S. Cl. ..... 239/33; 239/333; 239/436

[58] Field of Search ..... 222/192, 130, 222/131, 303, 284; 215/229, 384; 239/33, 289, 333, 436

[56] References Cited

U.S. PATENT DOCUMENTS

| | | | |
|---|---|---|---|
| 4,030,664 | 6/1977 | Tisbo et al. | 239/289 |
| 4,273,459 | 6/1981 | Hardy | 222/192 X |
| 4,807,813 | 2/1989 | Coleman | 239/153 |
| 4,815,635 | 3/1989 | Porter | 222/136 |
| 5,119,978 | 6/1992 | Kalamaras et al. | 224/32 |
| 5,143,390 | 9/1992 | Goldsmith | 280/201 |
| 5,215,231 | 6/1993 | Paczonay | 222/610 |
| 5,295,609 | 3/1994 | Robbin | 215/229 X |
| 5,326,124 | 7/1994 | Allemang | 280/288.4 |
| 5,529,217 | 6/1996 | Siegel | 239/229 X |

FOREIGN PATENT DOCUMENTS

| | | | |
|---|---|---|---|
| 117947 | 9/1984 | European Pat. Off. | 239/289 |
| 49003 | 3/1990 | WIPO | 222/131 |

*Primary Examiner*—Kevin Weldon

[57] ABSTRACT

The present invention relates to liquid dispensers, more specifically to a multi-port dispensing system that allows the user to either receive a spray of liquid for cooling or a stream of water for drinking. The preferred embodiment of the present invention consists of an ejector (or spray head) that attaches to a body. The body in turn attaches to a container. Once fully assembled, the user may drink liquid from the container by sucking on the straw protruding from the body. Simultaneously or sequentially with drinking from the straw, the user may receive a refreshing spray from the ejector.

40 Claims, 7 Drawing Sheets

PORTABLE MULTI-PORT LIQUID DISPENSING SYSTEM

This is a continuation of application Ser. No. 08/468,194 filed on Jun. 6, 1995 now abandoned.

FIELD OF THE INVENTION

The present invention relates to liquid dispensers, more specifically to a multi-port dispensing system that allows the user to either receive a spray of liquid for cooling or a stream of water for drinking.

BACKGROUND OF THE INVENTION

With the increase in outdoor activities, people must carry sufficient quantities of water to replenish lost water. Water can also be used to provide a cool refreshing mist. Prior to present invention, if a person wanted water for these two purposes, the person had to carry two separate water bottles. However, it is inconvenient to carry separate water bottles or containers. Such an inconvenience has been identified for strenuous sports, namely that of bicycling.

U.S. Pat. No. 5,326,124 to Allemang discloses a water delivery system that enables a bicycle rider to selectively receive a spray of water for cooling or a stream of water delivered into the rider's mouth for drinking. Allemang's invention may work well for a bicyclist, however, because of the complexity of his system, adapting it for portable personal use is not practical. In particular, Allemang uses a pressurized system requiring some kind of pump to provide pressure for the spaying and drinking functions. Allemang's design also forces the user to select from either receiving a drink or mist by rotating the hose into the proper position.

A similar apparatus to that of Allemang is shown in U.S. Pat. No. 4,815,635 to Porter. Porter uses a diaphragm-type pump and an adjustable nozzle to deliver to the rider either a cooling spray or stream of water. Porter has disadvantages beyond the obvious disadvantage of using two bottles. With Porter's apparatus, the user must verify that the nozzle is set for the appropriate function least the user be surprised when he receives a spray while trying to get a drink. Finally, Porter, as with Allemang, suffers from being unnecessarily complicated and costly to manufacture for personal portable uses.

In U.S. Pat. No. 5,158,218 to Wery, the rider may receive either a drink or a mist. However, Wery requires a complicated container because the container is pressurized. Additional complication is added to allow quick removal and replacement of the container. Neither of these concerns are present in a personal device as presented herein.

U.S. Pat. No. 5,215,231 to Paczonay shows yet another arrangement for providing a rider with water. Paczonay provides a lever on or near the handle bar of the bicycle. By squeezing this handle, the water bottle is compressed thereby forcing water into a tube that leads to the rider's mouth. Paczonay arrangement does not include an apparatus that can supply the rider with a mist of water.

SUMMARY OF THE INVENTION

According to this invention, there is provided a dispensing system for simultaneously dispensing a liquid from a mouth controlled port and an ejection port. The dispensing system is constructed around a body that has a first liquid channel. The first liquid channel has one end submerged in the liquid inside a container. There is a mouth controlled port connected to the second end of the first liquid channel. Next, the ejector is attached to the body. Finally there is a second liquid channel that channels the liquid inside the container to the ejector.

In a preferred embodiment, the body screws onto the container and the ejector screws onto the body. Both the first and second channels extend from the body into the container. An alternative embodiment requires only one liquid channel from the body into the container. Liquid is diverted into the both channels by coupling both channels together inside the body.

DESCRIPTION OF THE DRAWINGS

A better understanding of the invention may be had from the consideration of the following detailed description taken in conjunction with the accompanying drawings in which.

DETAILED DESCRIPTION OF THE INVENTION

Figure 1:
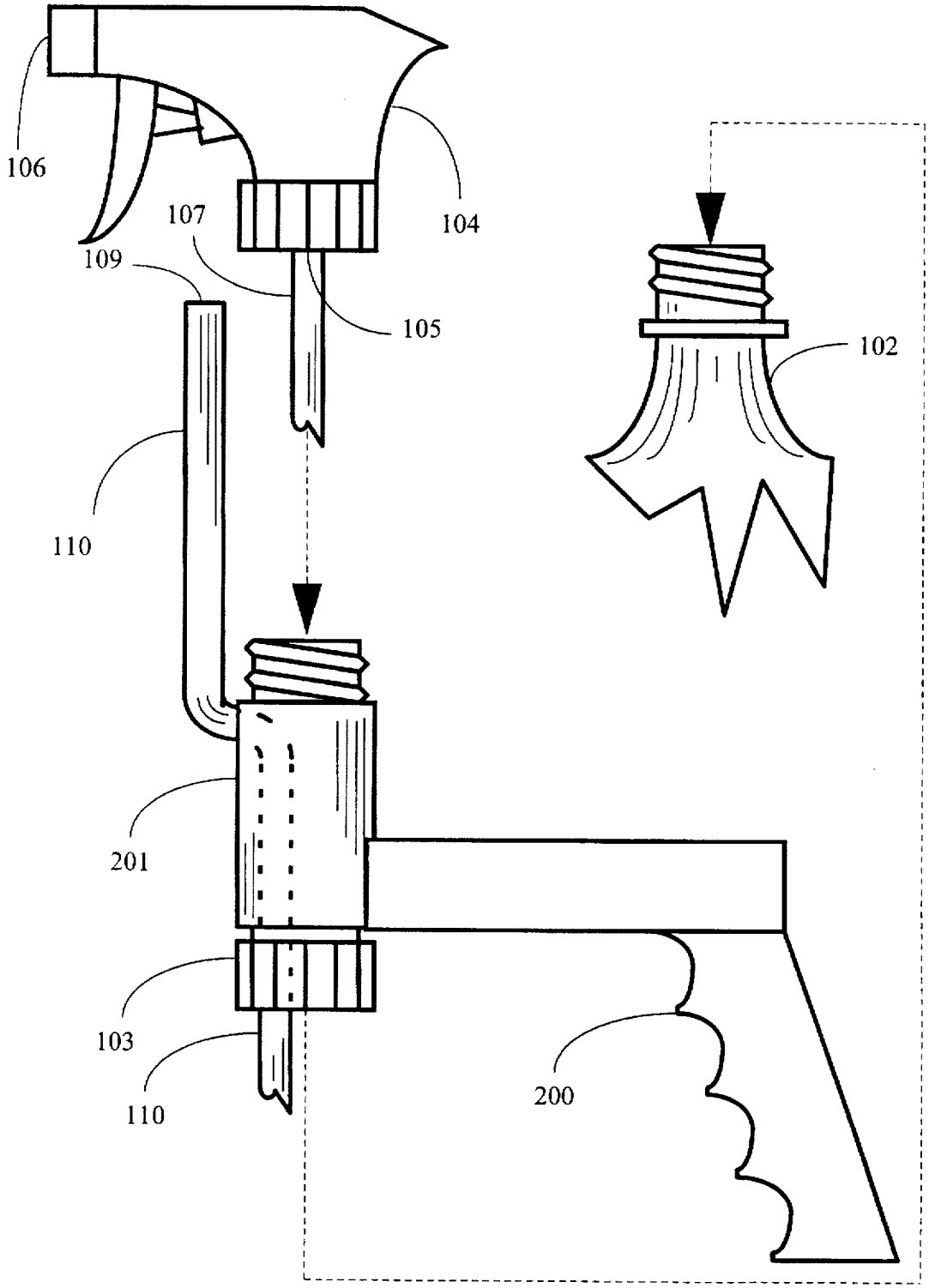
FIG. 1 shows a preferred embodiment in accordance with the present invention.

In the description that follows, like parts are indicated throughout the specification and drawings with the same reference numerals, respectively. The drawings are not necessarily to scale and the proportions of certain parts have been exaggerated to better illustrate operation of the invention. The present invention is not limited to the specific embodiments illustrated herein.

Referring to FIG. 1, where a preferred embodiment of the present invention is shown. At its most fundamental level, the invention consists of ejector 104 (or trigger type spray head) that attaches to body 201. Body 201, which is essentially hollow with a generally cylindrical outer shape, in turn attaches to container 102. Container 102 may be a water bottle or a PET type bottle, the exact type, shape, or size of the container is not important to the present invention. Once fully assembled, the user may drink liquid in container 102 by sucking on straw 110 protruding from body 201. Ejector 104 provides the user through ejection port 106 a mist, a stream or a mixture therein of the liquid in container 102.

Next, describing the operation of the preferred embodiment in greater detail, when the user activates ejector 104, liquid is drawn up tube 107 and forced out ejection port 106. Liquid may also pass through straw 110 to reach mouth controlled port 109. Such an arrangement allows for the simple addition of body 201 and accompanying straw 110 to an existing spray type bottle between the spray head and the bottle.

While one embodiment of ejector 104 will be described in detail, numerous embodiments are well known in the art. Representative patents disclosing alternative embodiments for the spray head are as follows: U.S. Pat. No. 3,129,856 to Boris, U.S. Pat. No. 3,998,363 to Beres et al., U.S. Pat. No. 4,489,890 to Martin, U.S. Pat. No. 4,819,835, Tasaki, and U.S. Pat. No. 5,205,442 to Harris et al., the disclosures of which are hereby incorporated by reference as though fully set forth herein. Embodiments using a Bernoulli principle type sprayer are also known in the art.

Still referring to FIG. 1, ejector 104 firmly attaches to body by means of screw cap 105 wherein screw cap 105 mates with receiving threads on body 201. By rotating screw cap 105 to mate firmly with body 201, ejector 104 and body 201 form a relatively rigid assembly. To ease assembly as just described, screw cap 105 should freely rotate about ejector 104.

With ejector 104 attached to body 201, channel 107 passes through body 201 and extends out the opposite end of body 201 relative to ejector 104. Viewing the assembly of ejector 104 and body 201 from the side, two channels (may also be referred to as straws or tubes) 110 and 107 extend beyond cap 103. The assembly is positioned over a suitable container 102 such that the two channels 110 and 107 enter container 102 through the opening. Body 201 is lowered onto container 102 wherein cap 103 attaches through a rotational motion onto container 102. To ease assembly as just described, cap 103 should freely rotate about body 201. After this final assembly, ejector 104, body 201 and container 102 are firmly attached together. One skilled in the art will readily understand that other means of connecting the parts together are available. The present application is not intended to limit the means to a screw cap as described.

In the preferred embodiment, body 201 may function as a handle for the final assembly. However, body 201 may include an appropriate appendage 200 that would function as a handle. Container 102 may also be molded so as to include a handle.

Figure 2:
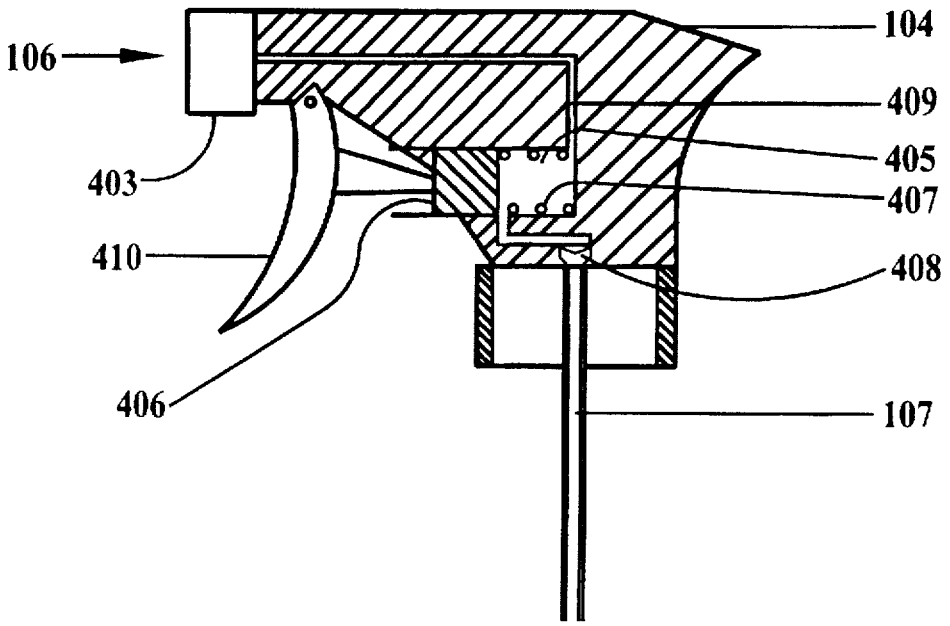
FIG. 2 shows in a simplified diagram, the inner working of one embodiment for the ejector of FIG. 1.

Referring briefly to FIG. 2, one embodiment of ejector 104 is shown in more detail. The trigger type ejector 104 (or spray head) dispenses a fine mist or droplets or even a stream of liquid depending on the adjustment on the ejection port 106. The simplified ejector shown in FIG. 2 consists essentially of an adjustable atomizer 403, which may be continuously adjustable between a fine mist and a stream of liquid. Many adjustable atomizers include a position that completely prevents ejection of liquid. A hand pump constitutes the remaining components of ejector 104.

A typical hand pump consists of a pumping chamber 405, which in the embodiment herein is integrated into the ejector housing. Pump piston 406 is positioned inside pumping chamber 405. Spring 407 insures that pump piston 406 is returned to the starting position when lever 410 is released. Check valve 408 allows liquid to flow into pumping chamber during the back stroke of pump piston 406 and prevents liquid from flowing during the power stroke of pump piston 406. Liquid conduit 409 directs the liquid from pumping chamber 405 to adjustable atomizer 403 during the power stroke of pump piston 406. Finally lever 410 provides the necessary leverage to allow the user to move pump piston 406.

In normal operation, the user squeezes lever 410 thereby forcing pump piston 406 into pumping chamber 405. Check valve 408 prevents liquid from escaping towards liquid channel 107 thus, the liquid in pumping chamber 405 may only escape through liquid conduit 409 and exit at adjustable atomizer 403. When the user releases lever 410, spring 407 returns pump piston 406 to its original position. Adjustable atomizer 403 prevents any air or liquid to returning through liquid conduit 409 during the pump piston back stroke, thereby creating a vacuum in pumping chamber 405. Once pump piston 406 returns to its original position, the vacuum is broken and liquid is drawn through check valve 408 thereby filling pumping chamber 405 ready for the next power stroke.

Figure 3:
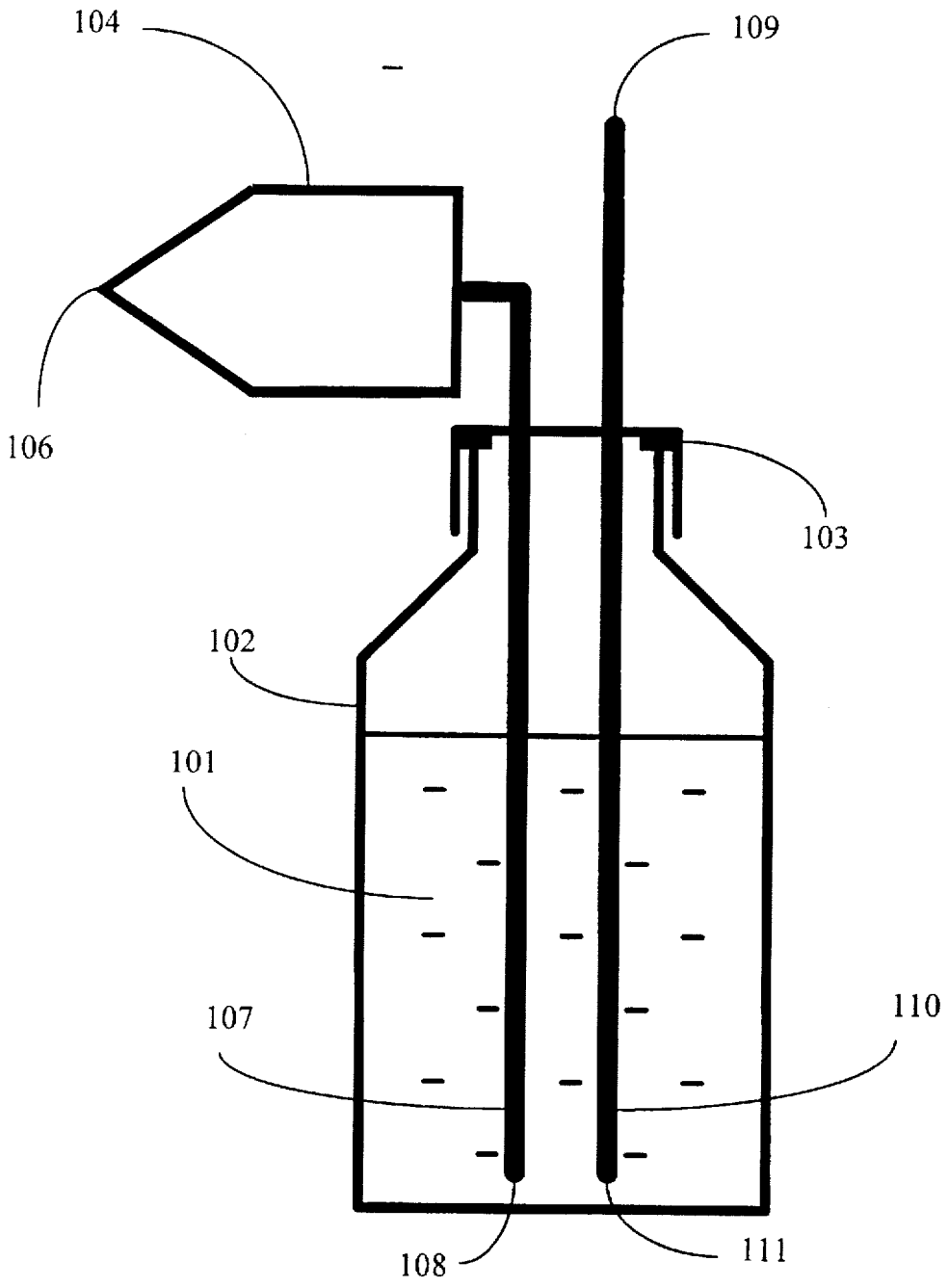
FIG. 3 is a schematic diagram of the preferred embodiment of FIG. 1.

Referring now to FIG. 3, where a schematic diagram of a preferred embodiment of the present invention is shown. As shown in FIG. 3, there are two possible paths for liquid 101 to exit out of container 102. First, liquid 101 may be withdrawn through straw 110 by entering inlet port 111, traveling up straw 110 to exit at mouth controlled port 109. The second path directs liquid into inlet 108 and through tube 107. Liquid then enters ejector 104, which ejects liquid through ejection port 106. Finally, cap 103 is attached to container 102.

For liquid 101 to exit from mouth controlled port 109, a pressure difference between the inside of container 102 and mouth controlled port 109 sufficient to draw liquid 101 through straw 110 must exist. In the preferred embodiment, this pressure difference is caused by the user "sucking" on mouth controlled port 109 thereby creating the necessary pressure.

Contrary to mouth controlled port 109, liquid 101 must be forced out of ejection port 106. Ejector 104 provides the necessary pressure difference to both draw liquid 101 through tube 107 and force the liquid out ejection port 106.

While FIGS. 1 and 3 show ejector 104 attaching to body 201, which in turn attaches to container 102, it should also be understood that body 201 and ejector 104 can be created as a single piece. If body 201 and ejector 104 are created as a single piece, then a single tube may be used to draw liquid to both ejector 104 and mouth controlled port 109. An embodiment using a single tube is shown in a schematic format in FIG. 4 with a physical embodiment shown in FIG. 5.

Figure 4:
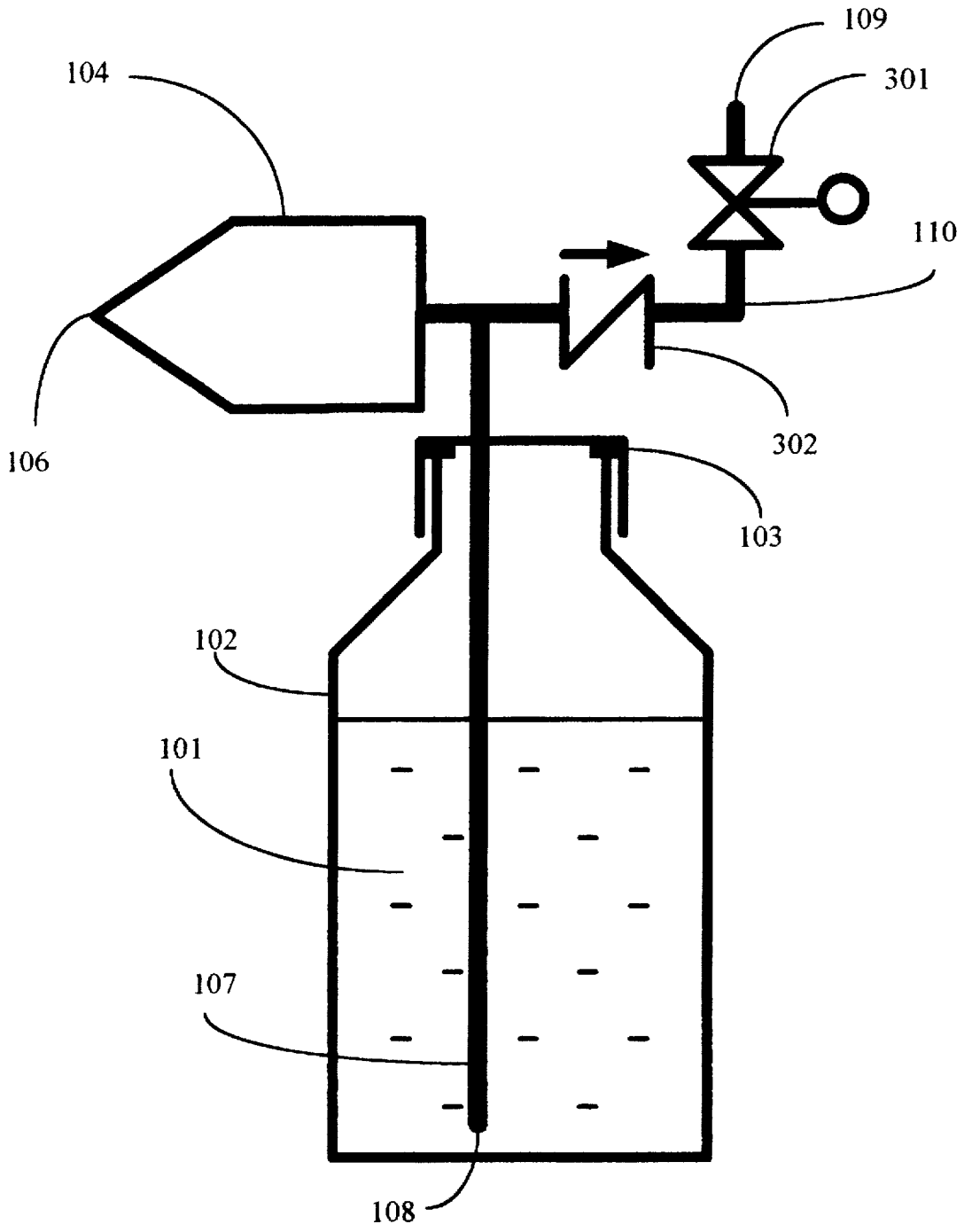
FIG. 4 is a schematic diagram of an alternative embodiment in accordance with the present invention.
Figure 5:
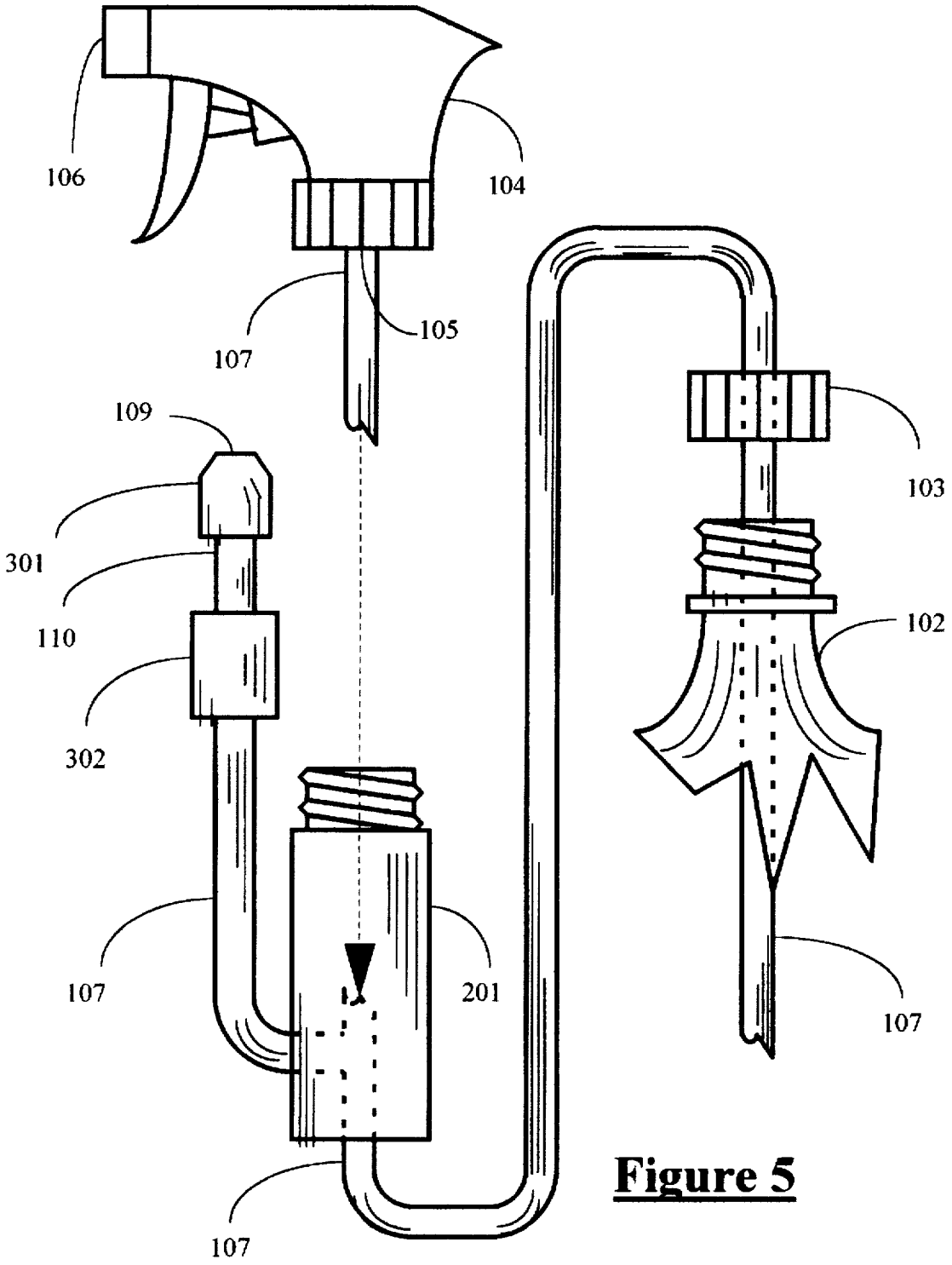
FIG. 5 shows the alternative embodiment of FIG. 4.

Referring to FIGS. 4 and 5, the ejector 104 operates in substantially the same manner as described above. Operation of mouth-controlled port 109 requires additional mechanisms. First, a check valve 302 isolates mouth controlled port 109 from inlet 108. Without check valve 302, ejector 104 would simultaneously draw liquid from inlet 108 and mouth controlled port 109. Because the path from mouth controlled port 109 presents less restriction to the flow of liquid than inlet 108, ejector 104 would empty the channel 110 and start receiving air. By placing check valve 302 in channel 110, ejector 104 can only retrieve liquid from inlet 108. Some examples of check valves can be found in U.S. Pat. No. 36,129,857 to Croy, U.S. Pat. No. 4,033,091 to Saponara, U.S. Pat. No. 4,723,670 to Robinson, U.S. Pat. No. 5,158,218 to Wery, and U.S. Pat. No. 5,215,231 to Paczonay, the disclosures of which are hereby incorporated by reference as though fully set forth herein.

Mouth actuated valve 301 provides the user an easy means of blocking the undesirable flow of liquid out of mouth controlled port 109. Undesirable flow may occur if one accidentally tips over the bottle. One type of mouth actuated valve is taught in U.S. Pat. No. 5,158,218 to Wery the disclosure of which is hereby incorporated by reference as though fully set forth herein. Other embodiments may require the user to pull the tip of the straw into an open position and then push it back into a closed position; such valves are common on "sports bottles".

One skilled in the art will understand that while check valve 302 and mouth actuated valve 301 are shown as separate items in FIG. 4 it is possible to integrate the two functions into a single device. It should also be noted that while the embodiment of FIG. 4 shows the addition of mouth actuated valve 301, this feature is independent and may easily be incorporated into the embodiment of FIG. 1.

FIG. 5 illustrates a physical embodiment for the schematic of FIG. 4. Comparing FIG. 5 to FIG. 1, will show that a single channel extends into container 102. A single channel in the alternative embodiment of FIG. 5 allows for body 201 to be located a distance from container 102. Such an arrangement may be desirable in numerous circumstances. For example, container 102 may be attached to the bicycle frame with a single tube (channel 107) routed through the bicycle towards the rider. Container 102 may be in a user's backpack or connected to their belt.

As described above, the embodiment of FIG. 5 is more conducive to manufacturing body 201 and ejector 104 as a single unit. If one wishes, ejector 104, body 201 and container 102 may all be manufactured as a single unit, provided some means of refilling the liquid is retained.

Figure 6:
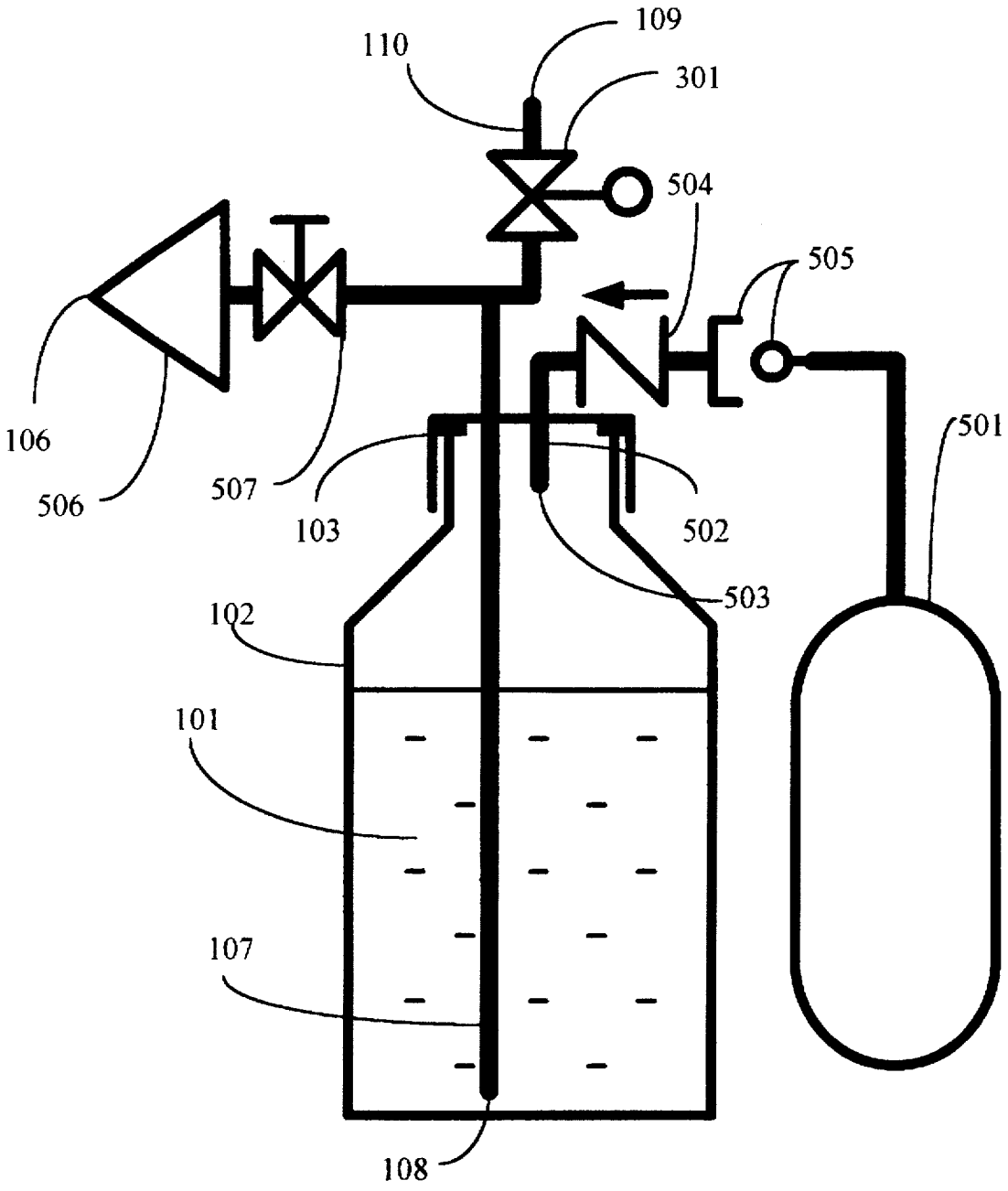
FIG. 6 is a schematic diagram of another alternative embodiment.

Some applications, it may be desirable to supply both drinking and misting functions without requiring the user to "suck" or pump the ejector. The embodiment shown in FIG. 6 uses a pressurizer 501 to pressurize container 102. Pressurizer 501 attaches through coupling 505, which allows for the temporary connection of pressurizer 501 for the purpose of pressurizing container 102. A one-way valve (check valve) 504 prevents pressure in container 102 from escaping through coupling 505 when pressurizer 501 is removed. However, removal of pressurizer 501 is optional. Pressurizer 501 may be permanently attached to either body 201 or container 102. If permanently attached, coupling 505 should be eliminated and check valve 504 is optional.

Other ways of pressurizing container 102 include: (1) A seltzer water bottle such as described in U.S. Pat. No. 4,660,748, 4,671,436, and 4,694,975, all to Hagan, and U.S. Pat. No. 4,773,571 to Hagan et al; (2) Pressurized container such as that disclosed in U.S. Pat No. 5,158,218 to Wary U.S. Pat. No. 3,998,364 to Hollander, U.S. Pat. No. 4,860,932 to Nagy, and U.S. Pat. No. 4,887,744 to Williams; (3) A pressurized container that has an expandable bag separating the liquid to be dispense and the pressurizing fluid such as air as disclosed in U.S. Pat. 5,143,390 to Goldsmith; (4) A hand operated pump as disclosed in U.S. Pat. No. 4,911,339 to Cushing, U.S. Pat. No. 1,372,968 to Lowy, or U.S. Pat. No. 3,129,857 to Croy et al.; (5) A carbonator as disclosed in U.S. Pat. No. 2,160,043 to Therm, U.S. Pat. No. 3,976,221 to Martin et al., or U.S. Pat. No. 4,735,348 to Santoiemmo et al.; (6) A gas supply such as disclosed in U.S. Pat. No. 4,402,429 to Driessche or U.S. Pat. No. 5,022,565 to Sturman et al.; (7) A compressible container that may compressed by the users the hands or as disclosed in U.S. Pat. No. 5,215,231 to Paczonay; (8) injection of pressurized liquid as disclosed in U.S. Pat. No. 5,373,975 to Husted, disclosures of which are hereby incorporated by reference as though fully set forth herein.

Pressure from pressurizer 501 passes through coupling 505, check valve 504, pressurization channel 502 and exits into container at injection port 503.

Once container 102 is pressurized, the user may receive a refreshing mist from ejector port by activating ejector control valve 507. In a similar fashion, the user may receive a drink from mouth controlled port 109 by operating mouth controlled valve 301. One skilled in the art would understand that other devices may work in the present invention. For example, because container 102 is pressurized, an ejector is optional. With the ejector of FIG. 1 eliminated, ejection port 106 is created by way of nozzle 506.

Figure 7:
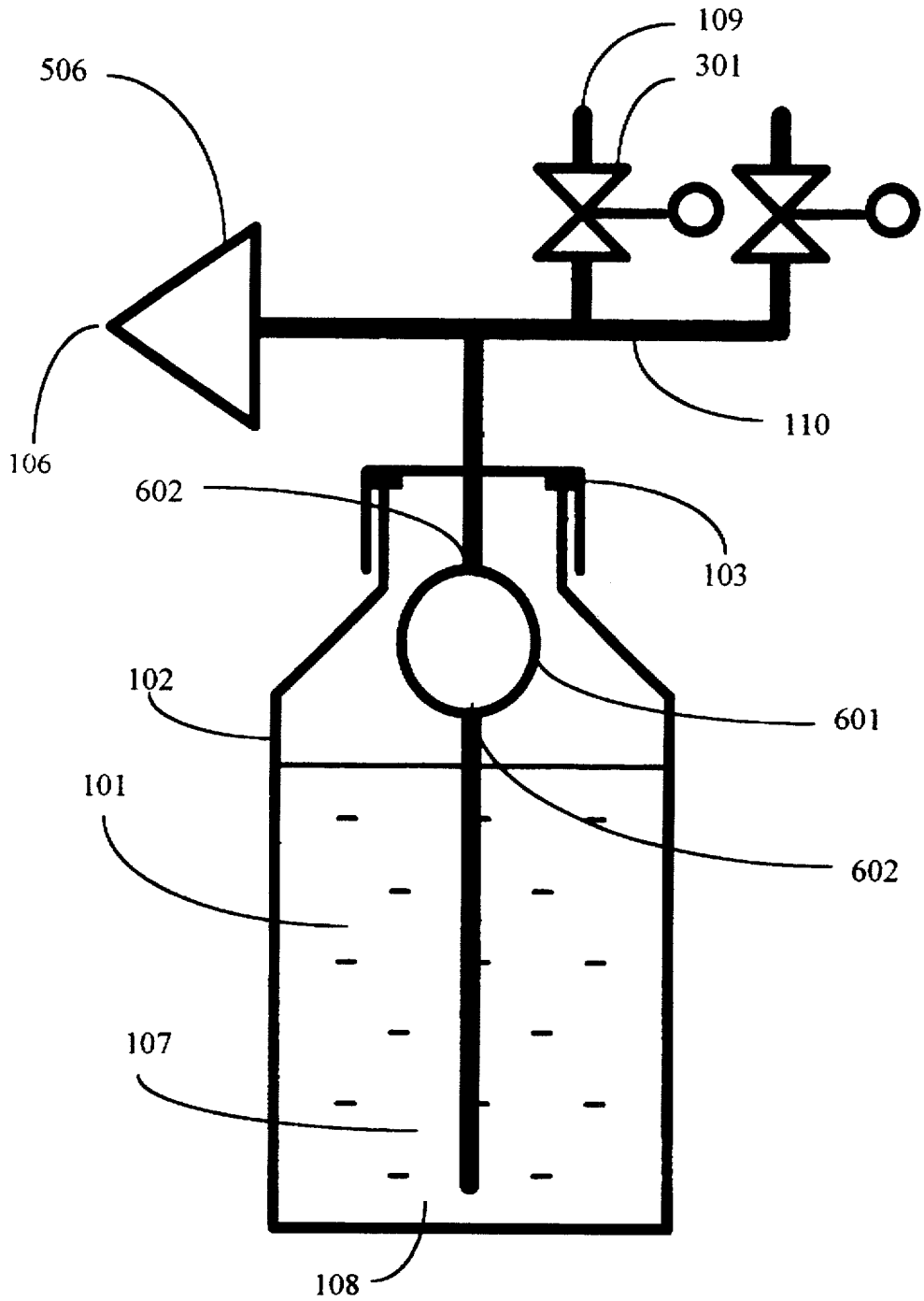
FIG. 7 is a schematic diagram of yet another alternative embodiment.

Another possible modification is shown in FIG. 7, which incorporates two distinct and separate additions. First, an pump 601 is added. Operation of pump 601 pressurizes the liquid in channel 110 without pressurizing the entire container. As a second feature of FIG. 7, a second mouth controlled port 109 has been added. It should be apparent to one skilled in the art that additional mouth controlled ports and ejectors may be added independent of each other and the means in which the liquid is delivered.

Although the preferred embodiment of the invention has been illustrated, and that form described, it is readily apparent to those skilled in the art that various modifications may be made therein without departing from the spirit of the invention or from the scope of the appended claims.

One such modifications relates to the ejector. Ejector 104 has been represented as a "trigger type spray head". However, ejector 104 may also be the presently popular high powered "water guns", also referred to as "water cannon" as disclosed in U.S. Pat. No. 5,292,032 and 5,150,819 both to Johnson et al., and U.S. Pat. No. 4,022,350 to Amron, the disclosures of which are hereby incorporated by reference as though fully set forth herein. Thus, by adding the second channel to an existing "water gun", the "water gun" user may now receive a drink from the water reservoir. Because the water reservoir in the water gun may be pressurized, the embodiment of FIG. 6 would generally be used when adding a mouth controlled port. In particular, when adding a mouth controlled port to a pressurized water gun, the mouth controlled port must have a separate control valve to selectively allow water to flow out the mouth controlled port. Other water toys may benefit from the addition of a mouth controlled port.

What is claimed is:

1. A dispensing system for dispensing a single liquid, said dispensing system comprising:

a container defining a single chamber, said single liquid being contained in said single chamber;

a body having a first liquid channel, said first liquid channel having a first end and a second end, said first end submerged in said single liquid;

a mouth controlled port connected to said second end of said first liquid channel;

an ejector attached to said body; and a second liquid channel operative inside said body to channel said single liquid to said ejector.

2. The dispensing system of claim 1 wherein said body is removably attached to said container.

3. The dispensing system of claim 1 wherein said body is permanently attached to said container.

4. The dispensing system of claim 1 wherein said ejector is removably attached to said body.

5. The dispensing system of claim 1 wherein said ejector is permanently attached to said body.

6. The dispensing system of claim 1 wherein said second liquid channel extends through said body and into said single liquid.

7. The dispensing system of claim 1 wherein said ejector is a sprayer means.

8. The dispensing system of claim 7 said sprayer means further comprising a nozzle.

9. The dispensing system of claim 7 said sprayer means further comprising:

an atomizer; and a pump connected to said atomizer and said second liquid channel.

10. The dispensing system of claim 9 wherein said atomizer is adjustable between ejecting a mist and ejecting a stream.

11. The dispensing system of claim 1 further comprising a handle rigidly attached to said body.

12. The dispensing system of claim 1 wherein said mouth controlled port further comprising:

a mouth actuated valve having an open position and a closed position, liquid flows out said mouth controlled port when said mouth actuated valve is in said open position, in the alternative, liquid is prevented from flowing out said mouth controlled port when said mouth actuated valve in said closed position.

13. The dispensing system of claim 12 wherein said mouth actuated valve transitions between said open position and said closed position by an electrical means, said electrical means being controlled by said mouth controlled port.

14. The dispensing system of claim 1 further comprising:

a pressurization means for transferring said liquid from inside said container to said mouth controlled port and said ejector.

15. A dispensing system for dispensing a single liquid, said dispensing system comprising:

a container defining a single chamber, said single liquid being contained in said single chamber;

a body attached to said container;

an ejector attached to said body;

a first liquid channel extending from said single liquid to said ejector;

a mouth controlled port connected to said body; and a second liquid channel operative inside said body to direct said single liquid to said mouth controlled port.

16. The dispensing system of claim 15 wherein said body is removably attached to said container.

17. The dispensing system of claim 15 wherein said body is permanently attached to said container.

18. The dispensing system of claim 15 wherein said ejector is removably attached to said body.

19. The dispensing system of claim 15 wherein said ejector is permanently attached to said body.

20. The dispensing system of claim 15 wherein said second liquid channel extends through said body and into said single liquid.

21. The dispensing system of claim 18 wherein said ejector is a sprayer means.

22. The dispensing system of claim 21 said sprayer means further comprising a nozzle.

23. The dispensing system of claim 21 said sprayer means further comprising:

an adjustable atomizer; and a pump connected to said adjustable atomizer and said first liquid channel.

24. The dispensing system of claim 23 wherein said pump is manually operated.

25. The dispensing system of claim 23 wherein said pump is electrically operated.

26. The dispensing system of claim 25 wherein said mouth controlled port activates said electrically operated pump.

27. The dispensing system of claim 23 wherein said adjustable atomizer is adjustable between ejecting a mist and ejecting a stream.

28. The dispensing system of claim 18 further comprising a handle rigidly attached to said body.

29. A dispensing system for dispensing a single liquid, said dispensing system comprising:

a container defining a single chamber, said single liquid being contained in said single chamber;

a body removably attached to said container;

an ejector attached to said body;

a first liquid channel extending from said single liquid to said ejector;

a mouth controlled port connected to said body; and a second liquid channel connected to said mouth controlled port, said second liquid channel extends through said body and into said single liquid.

30. The dispensing system of claim 29 wherein said ejector is a sprayer means.

31. The dispensing system of claim 30 said sprayer means further comprising a nozzle.

32. The dispensing system of claim 30 said sprayer means further comprising:

an adjustable atomizer; and a pump connected to said adjustable atomizer and said first liquid channel.

33. The dispensing system of claim 32 wherein said pump is manually operated.

34. The dispensing system of claim 32 wherein said pump is electrically operated.

35. The dispensing system of claim 32 wherein said adjustable atomizer is adjustable between ejecting a mist and ejecting a stream.

36. The dispensing system of claim 29 further comprising a handle rigidly attached to said body.

37. The dispensing system of claim 29 wherein said ejector is removably attached to said body.

38. The dispensing system of claim 29 wherein said ejector is permanently attached to said body.

39. A dispensing system for dispensing a single liquid, said dispensing system comprising:

a container defining a single chamber, said single liquid being contained in said single chamber;

a mouth port means for extracting said single liquid from said container into a mouth; and an ejector means for extracting said single liquid, said ejector means propels said single liquid away from said ejector means.

40. The dispensing system of claim 39 wherein said mouth port means is a straw.

* * * * *